US005987781A

United States Patent [19]

Pavesi et al.

[11] Patent Number: 5,987,781

[45] Date of Patent: Nov. 23, 1999

[54] SPORTS FOOTWEAR INCORPORATING A PLURALITY OF INSERTS WITH DIFFERENT ELASTIC RESPONSE TO STRESSING BY THE USER'S FOOT

[75] Inventors: Filippo Pavesi, Turin, Italy; King Chee Wong, Kowloon, The Hong Kong Special Administrative Region of the People's Republic of China

[73] Assignee: Global Sports Technologies, Inc., Tortola, Virgin Islands (Br.)

[21] Appl. No.: 09/092,643

[22] Filed: Jun. 9, 1998

[30] Foreign Application Priority Data

Jun. 12, 1997 [IT] Italy ..... MI97A1390

[51] Int. Cl.[6] ..... A43B 13/20

[52] U.S. Cl. ..... 36/29; 36/35 B

[58] Field of Search ..... 36/29, 3 B, 35 B, 36/28

[56] References Cited

U.S. PATENT DOCUMENTS 3,253,355 5/1966 Menken .
4,316,335 2/1982 Giese et al. .
5,092,060 3/1992 Frachey et al. .
5,134,790 8/1992 Woitschaetzke et al. .
5,369,896 12/1994 Frachey et al. .

FOREIGN PATENT DOCUMENTS 0 399 332 11/1990 European Pat. Off. .
WO 82/00571 3/1982 WIPO .

*Primary Examiner*—Ted Kavanaugh
*Attorney, Agent, or Firm*—Oblon, Spivak, McClelland, Maier & Neustadt, P.C.

[57] ABSTRACT

Sports footwear with a vamp, and a lower support part including a sole unit, the lower support part having a lower portion or treading sole for contacting the ground and an intersole overlying the treading sole, wherein within said support part there is present at least a first insert containing elements which deform elastically when subjected to pressure and which are enclosed within an air-containing sealed casing positioned corresponding with the heel region of the sole unit. A further insert is positioned corresponding with the metatarsal region of the foot and also includes a casing containing elements deformable when subjected to pressure. The deformable elements positioned in the insert corresponding with the heel region have a different response to pressure-stressing than the elements present in the insert corresponding with the metatarsal region of the foot.

24 Claims, 2 Drawing Sheets

SPORTS FOOTWEAR INCORPORATING A PLURALITY OF INSERTS WITH DIFFERENT ELASTIC RESPONSE TO STRESSING BY THE USER'S FOOT

FIELD OF THE INVENTION

This invention relates to sports footwear in accordance with the introduction to the main claim.

DISCUSSION OF THE BACKGROUND

Sports footwear, in particular for sports such as running, basketball, tennis, volleyball, walking etc. comprises a sole unit associated with a vamp and is divisible substantially into two well defined parts, namely a lower part or treading sole making contact with the ground and generally of rubber or similar material, and an upper part or intersole overlying the lower part. The intersole is usually formed of expanded elastomers or mixtures thereof, such as ethylvinylacetate or polyurethane.

For many years it has been required that sports footwear of the aforesaid type be able to return to the user at least a part of the impact force which the user generates on the ground during his movement, so as to facilitate lifting of the foot and make this movement easier.

Besides the aforesaid characteristic, a particular requirement of such footwear is, inter alia, to optimize the position of the user's foot at the moment of contact with the ground in order to prevent deformation of the bone structure of the user's limb. To this must be added the requirement of facilitating the natural sequence of pronation and supination movements by the user.

Various types of sports footwear are known which attempt to satisfy the aforesaid requirements. From U.S. Pat. No. 5,092,060 and U.S. Pat. No. 5,369,896, sports footwear are known of the type comprising a vamp, a lower support part for said vamp, and a sole unit provided in this lower part. Inside the sole unit, within at least that part thereof positioned in correspondence with the user's heel, there is provided an insert comprising an airtight casing containing a plurality of elastically deformable elements substantially spaced apart in a uniform manner. These elements have substantially the same height and are barrel-shaped. A modification of this arrangement uses an insert of the aforesaid type also positioned in that part of the sole unit corresponding to the metatarsal regions of the user's foot. The elastically deformable elements are connected together by arms lying substantially in a horizontal plane and connected to the largest cross-section region of said elements.

Further footwear is known, forming the subject of a different patent in the name of the present applicant, comprising a sole unit of the aforesaid type provided with at least one insert having elastically deformable elements inserted into an airtight casing. These elements have different heights to give the casing upper surface facing the user's foot a concave shape, in order to provide optimum stability to the user's foot during movement.

In these arrangements and in others known in the state of the art, the deformable elements of the various inserts (or those provided within the sole unit) possess homogeneous mechanical characteristics. In other words, these elements all provide substantially the same elastic response to their stressing by the user's foot during his movement along the ground.

Other arrangements are known comprising a sole unit in which inserts are provided comprising a casing containing air or one or more fluids in general. These arrangements enable the response of the various parts of the insert to be differentiated according to their stressing during the movement of the user and enable different damping characteristics to be obtained for the impact force generated by the user on the ground. These arrangements are, however, very costly and often do not achieve optimum differential response to stressing.

SUMMARY OF THE INVENTION

An object of the present invention is to provide sports footwear which is improved compared with known sports footwear.

A particular object of the invention is to provide sports footwear of the aforesaid type with improved antitraumatic properties so as to allow the user, and in particular an athlete, increased safety during use (and, in the case of an athlete, the facility for harder training), against the risk of possible accident. In the particular case of an athlete, this makes it possible to achieve better performance.

A further object of the present invention is to provide footwear of the stated type which rebalances the user's foot following its resting on the ground, thus increasing its stability and reducing the energy expended in controlling the movement. This results in increased efficiency.

A further object is to provide footwear of the aforesaid type which reduces overloading, which in the user's limbs is generally concentrated in the highest pressure areas, so increasing support upstream of the areas concerned and hence reducing pressure thereon; this results in reduced injury deriving from overloading, such as fractures or muscular lesion generated by such stressing.

A further object is to provide footwear of the aforesaid type which is of low weight, a cost consistent therewith, and a pleasant general appearance.

These and further objects which will be apparent to the expert of the art are attained by footwear in accordance with the accompanying claims.

BRIEF DESCRIPTION OF THE DRAWINGS

The present invention will be more apparent from the accompanying figures, which are provided by way of non-limiting example and in which.

DESCRIPTION OF THE PREFERRED EMBODIMENT

Figure 1:
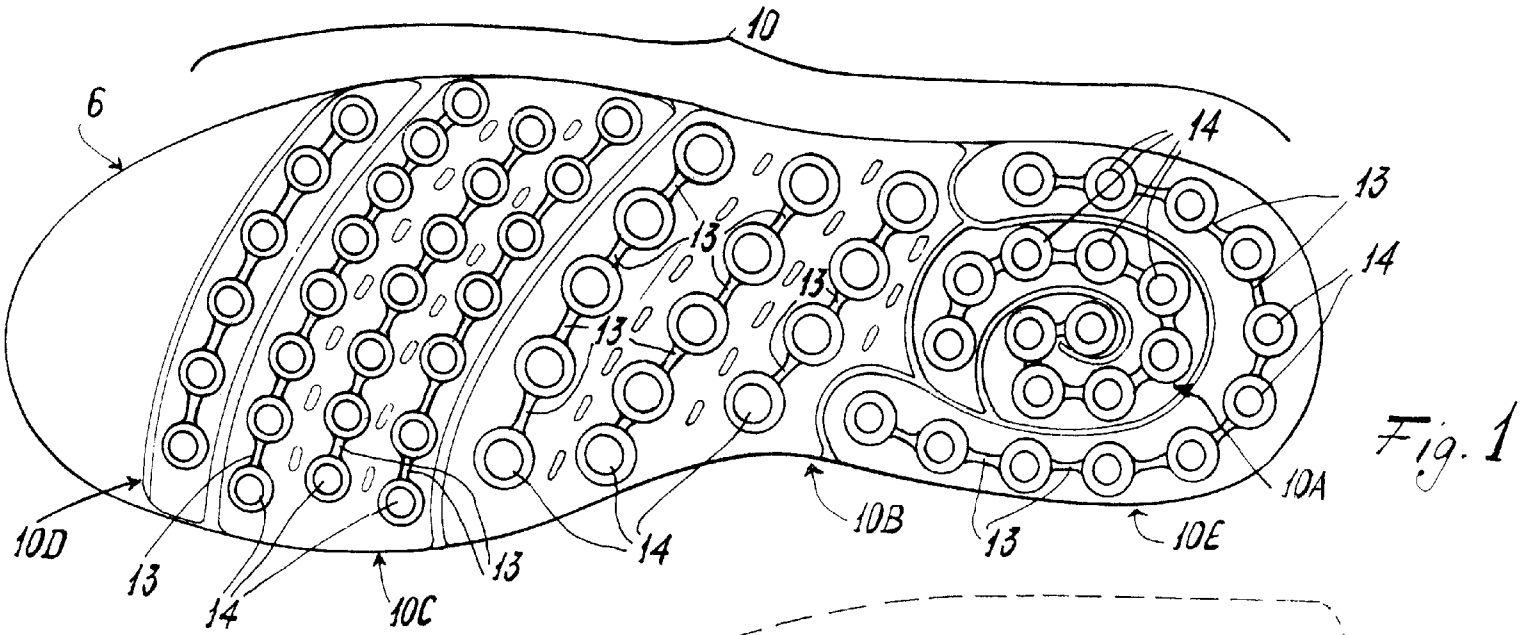
FIG. 1 is a schematic plan view of footwear formed in accordance with the present invention.

With reference to the said figures, sports footwear comprises a vamp 1 and a lower part comprising a sole unit 3 (and other parts such as a wedge or insoles, not shown). This latter comprises a lower part or tread 4, generally of rubber or similar material, for contact with the ground.

With this tread there is upperly associated an intersole 6 constructed of an elastomer or a mixture of elastomers such as ethylvinylacetate or polyurethane. Within the intersole 6 there is a least one seat 8 (as in the figures, or several seats separated from each other) containing at least one insert 10 consisting of an airtight casing (containing a fluid such as air) in which there are provided a plurality of elastically deformable elements 14 connected together, at least in succession, by arms or bridges 13 lying in the same plane. In the embodiment shown in the figures, this insert occupies the entire seat 8 which extends from that region K of the sole unit at the user's heel to the metatarsal region M of the sole, and also occupies the sole region in correspondence with the user's foot arch (or arch region P). Alternatively, if several seats are provided at the regions K, M and P, several corresponding inserts are provided in these seats.

Figure 3:
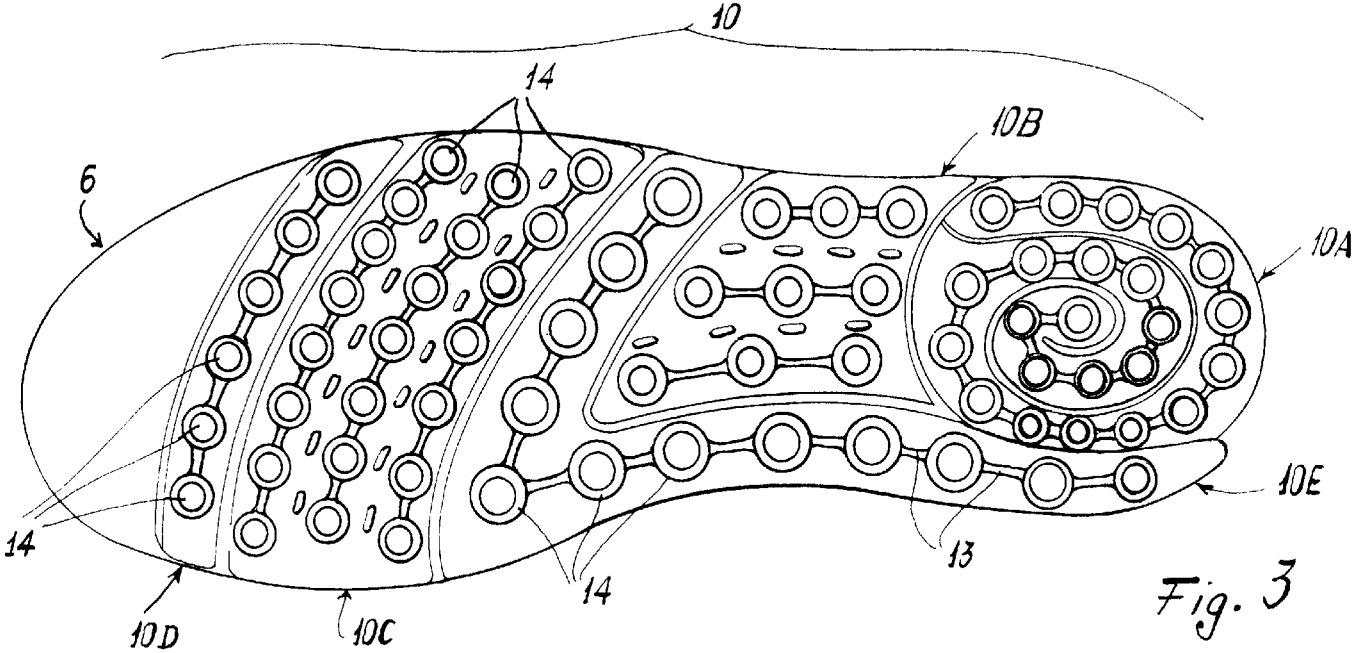
FIG. 3 is a view similar to that of FIG. 1, showing a modification of the present invention.

Preferably however, even if only one seat 8 is provided, in the said regions K, M and P there are positioned a plurality of inserts 10 (as shown) which in FIGS. 1 and 3 are indicated by the reference numerals 10A, 10B, 10C, 10D, 10E.

According to the invention, the elastically deformable elements 14 present in the different sole regions (K, M and P) display different responses to pressure-stressing (ie to the squeezing force exerted on them by the user during his movement, racing, jumping etc.).

In particular, the inserts 10A and 10C present in the sole regions K and M, and which are required to provide maximum damping to the impact force exerted by the user's foot on the ground, possess high compressibility. In contrast, the inserts 10B and 10D are less compressible than the aforesaid, while the insert 10E possesses greater rigidity than the other inserts. The purpose of this is to achieve the objects set by the invention for the footwear formed in accordance with the figures.

More specifically, the insert 10A is of circular or substantially ovoidal shape. Its purpose is to damp and dissipate as much as possible the impact force generated by the user's heel on the ground. This is because this part of the foot is substantially rigid and in itself is not able to damp the impacts undergone by the foot on touching the ground, in particular during racing, jumping or the like.

The insert 10C has deformable elements 14 which are more elastic than those of the insert 10A and has a shape such as to fit below the ends of the metatarsus of the user's foot.

In contrast the inserts 10B and 10D have deformable elements 14 which, as stated, are more rigid than the inserts 10A and 10C, whereas the elements 14 of the insert 10E have to be still more rigid than those of the other inserts. It should be noted that the insert 10E can have different shapes depending on the use for which the footwear is proposed. In the case of running shoes in particular, this is to the side of the insert 10A (FIG. 3) in the medial side of the rear of the foot so as to control physiological pronation movement. This insert precedes, towards the forefoot, the insert 10C positioned in the metatarsal region M of the sole unit 3, to provide support for the foot upstream of the metatarsi in order to ensure stability of the transverse front arch of the foot under load. Alternatively, the insert 10E can be at least partly annular (for example in the shape of a horseshoe) and hence embrace the insert 10A.

The different responses to the pressure-stressing of the elements 14 of the various inserts can be obtained in different ways by varying the choice of their constituent materials, of their shape and cross-section, or of the intersole area occupied by them.

For example, greater insert rigidity can be obtained by increasing their density. This is particularly so if they are of polyurethane construction. Alternatively, in the case of solid polymers, elements 14 for greater rigidity inserts can be formed from polymers of greater elastic modulus. According to another possibility, to achieve greater deformation of an insert, its elements can be formed with smaller dimensions than the deformable elements 14 of another insert for which greater deformation is required.

With regard to the deformable elements 14 in general, these can be formed of expanded elastomers (for example polyurethane), allowing their weight to be reduced. In contrast, by using elastomers of different rigidity, in addition to different inserts with different levels of compressibility as stated, it is possible to obtain areas of different compressibilities in one and the same insert 10A, B, C, D, E, for example so that the sole unit behaves gradually in responding to the pressure stressing of its different regions. For example, such graduality can be achieved in the insert 10B in passing from the heel region K to the metatarsal region M. This is possible in particular when the insert (such as 10B or 10C) comprises deformable elements 14 positioned along parallel rows which are not interconnected.

The elements 14 can be shaped as a solid of rotation, a barrel etc., with a circular, elliptical, polygonal or other base (such as the star shapes of FIG. 4), and are welded (for example by thermowelding) to the casing 11 which contains them. They can be arranged as in the figure, with their longitudinal axis H perpendicular to the sole unit 3 (or to the ground or plane on which they rest) or be arranged within the relative casing along the other two axes of the space (not shown) containing the axis H.

This enables various responses to be obtained to the pressure stressing of the various sole regions, according to the spatial arrangement of the longitudinal axis of these elements.

If these latter are of a polygonal shape (for example hexagonal) or star shape (see FIG. 4), they provide excellent response to stressing received along any one of two mutually perpendicular axes, of which one is the aforesaid longitudinal axis H.

Figure 2:
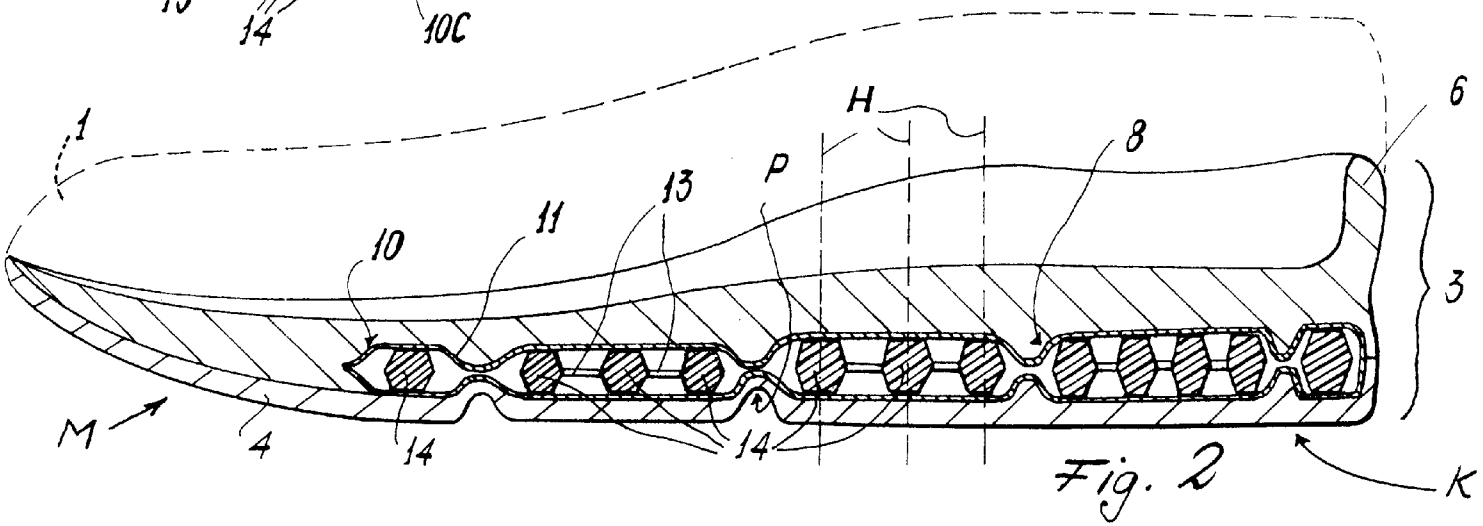
FIG. 2 is a side view of the sole unit of FIG. 1.
Figure 4:
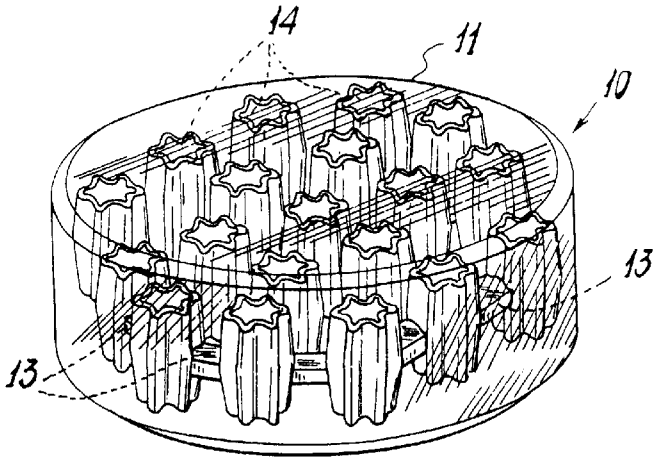
FIG. 4 is a perspective view of one embodiment of a part of the present invention.

The elements 14 can be made solid (as in FIGS. 1 to 3) or hollow (as in FIG. 4). In this latter case they can also internally contain a fluid (such as air, liquid or a gas), either at atmospheric or other than atmospheric pressure. If the fluid is a gas different from air, it must be a toxic and non-pollutant, such as nitrogen, carbon dioxide, sulphur hexafluoride, argon or the like. With regard to liquids, these must be inert, atoxic and preferably water-soluble, such as glycols, polyglycols, perfluorinated liquids (oils), polyesters or petroleum products such as kerosene or oils usable in vehicle engines. High-boiling alcohols can also be used. If such liquids or gases are used, the elements 14 must obviously be formed of a material of low gas permeability and not attachable by the liquids, such as plastic polyurethane or polyester-urethan thermoplastic resin.

Finally, said elements 14 can be prepared by various production processes, such as injection-molding, extrusion, blow-molding or vacuum-forming. The elements can be prepared as a sequence of elements located in succession. This succession or row of elements can then be divided into a plurality of successions to be positioned, for example as shown in the figures, in the inserts 10B and 10C, side by side and substantially parallel to each other. Alternatively, a succession can be positioned as a spiral (as in the insert 10A), along a circular or arched or angled line (as in the inserts 10D and 10E of FIG. 3 respectively). Other arrangements are however possible falling within the same inventive concept. For example, for the invention to be able to attain its objects, it is sufficient that the sole unit contains the elements 10A and 10C with the deformable elements providing a different response to pressure-stressing by the user's foot during his movement (as described heretofore). In the other regions of the sole unit in which in the figures the inserts 10C, 10D and 10E are present, these latter can be replaced by traditional intersole materials (ethylvinylacetate or the like) with added elements such as arches, vaults and plates constructed of rigid, light and highly elastic materials such as composite materials comprising carbon fibers, glass fibers, aramid fibers (Kevlar) or polyester, or their combinations or the like.

In addition, the deformable elements 14 of at least one of the inserts 10A, B, C, D and E can be positioned either in a single plane or on several superposed levels.

These arrangements are also to be considered as falling within the scope of the present document.

We claim:

1. Sports footwear; which comprises:

a vamp, a lower support part comprising a sole unit, said sole unit having one of a lower portion and a treading sole, for contacting the ground and an intersole overlying said one of said lower portion and said treading sole, said support part having positioned therein at least a first insert, containing first elements which deform elastically under pressure and an air-containing, air-tightly sealed casing enclosing said elements and being positioned corresponding with a heel region, of the sole unit, and a second insert positioned corresponding with a metatarsal region of the foot; and a casing containing second deformable elements which are deformable under pressure, wherein the first deformable elements have a different pressure-stressing response characteristic than the second deformable elements and have a different compression resistance.

2. Sports footwear as claimed in claim 1, which comprises a third insert positioned corresponding with a plantar arch region and comprising third deformable elements enclosed within an air-containing sealed casing, said third deformable elements having a different response to stressing than the first and second elements positionded in the heel region (K) and metatarsal regopm (M) of said sole unit and a fourth insert provided forward of the metatarsal region of the sole unit, said fourth insert comprising fourth deformable elements enclosed within an air-containing sealed casing and having substantially equivalent deformation characteristics as the insert positioned in the plantar arch region.

3. Sports footwear as claimed in claims 1 or 2, comprising a fifth insert provided at least partly within the heel region of the sole unit and comprising a plurality of fifth deformable elements inserted into an air-containing sealed casing, said fifth elements having a different response to pressure-stressing than the second elements.

4. Sports footwear as claimed in claim 3, wherein the fifth deformable elements have a greater rigidity than the third and fourth deformable elements, said third and fourth elements having greater rigidity than the second deformable elements, and the second deformable elements being more elastic than the first deformable elements.

5. Sports footwear as claimed in claim 3, wherein the fifth insert at least partly surrounds the first insert and forms a ring portion around the first insert.

6. Sports footwear as claimed in claim 3, wherein the fifth insert is closer to the heel portion than the second insert.

7. Sports footwear as claimed in claim 1, wherein the deformable elements of each insert (19A, B, C, D, E) are arranged in mutual succession and are connected together by one of interconnecting arms and bridges.

8. Sports footwear as claimed in claim 1, wherein the first deformable elements are positioned along a spiral within the first insert.

9. Sports footwear as claimed in claim 1, wherein the second and third deformable elements are positioned along a plurality of mutually independent parallel lines respectively within the second and third inserts.

10. Sports footwear as claimed in claim 1, wherein the deformable elements, of each of the inserts are barrel-shaped.

11. Sports footwear as claimed in claim 1, characterized in that the deformable elements of each of the inserts are shaped as a solid of revolution.

12. Sports footwear as claimed in claim 1, wherein the deformable elements are dihedrons of one of a polygonal section, a star and a substantially similarly shaped section.

13. Sports footwear as claimed in claim 1 wherein the deformable elements are solids.

14. Sports footwear as claimed in claim 1 wherein the deformable elements, are hollow shaped.

15. Sports footwear as claimed in claim 14, wherein the deformable elements contain a fluid.

16. Sports footwear as claimed in claim 15, wherein the fluid is a liquid.

17. Sports footwear as claimed in claim 15, wherein the fluid is a gas.

18. Sports footwear as claimed in claim 15, wherein the fluid is at a pressure different from atmospheric pressure.

19. Sports footwear as claimed in claim 1, wherein the inserts are respectively positioned in seats provided in the sole unit.

20. Sports footwear as claimed in claim 1, wherein in at least within one insert the deformable elements located therein have differential response to the pressure-stressing than that to which said one insert is subjected.

21. Sports footwear as claimed in claim 1, wherein the first and second insert comprise portions of a single insert inserter into a corresponding seat in the sole unit.

22. Sports footwear as claimed in claim 21, wherein the single insert present in the sole unit comprises at least insert selected from the group consisting of the third insert, the fourth insert and the fifth insert.

23. Sports footwear as claimed in claim 1, wherein the deformable element are secured to the sealed casing.

24. Sports footwear as claimed in claim 1, wherein the deformable elements are secured to the casing which contains them.

* * * * *